US005192012A

United States Patent [19]

Schafer et al.

[11] Patent Number: 5,192,012

[45] Date of Patent: Mar. 9, 1993

[54] NAIL DRIVING TOOL

[75] Inventors: Manfred Schafer, Bad Homburg; Alfred Schneider, Langen; Horst Tacke, Bad Vilbel; Gerhart Hartmann, Frankfurt am Main, all of Fed. Rep. of Germany

[73] Assignee: ITW Befestigungssysteme GmbH, Eschborn-Niederhochstadt, Fed. Rep. of Germany

[21] Appl. No.: 802,573

[22] Filed: Dec. 5, 1991

[30] Foreign Application Priority Data

Dec. 5, 1990 [DE] Fed. Rep. of Germany ... 9016493[U]

[51] Int. Cl.[5] ..... B25C 1/00

[52] U.S. Cl. ..... 227/113; 227/119; 227/120

[58] Field of Search ..... 227/113, 114, 115, 119, 227/120

[56] References Cited

U.S. PATENT DOCUMENTS

| | | | |
|---|---|---|---|
| 3,765,588 | 10/1973 | Frederickson | 227/113 |
| 4,270,687 | 6/1981 | Maurer | 227/113 |
| 4,370,093 | 1/1983 | Lund | 227/113 X |
| 4,389,012 | 6/1983 | Grikis et al. | 227/113 X |
| 4,416,172 | 11/1983 | Medinger | 227/113 X |
| 4,487,355 | 12/1984 | Ginnow et al. | 227/113 X |
| 4,616,774 | 10/1986 | Yasuda | 227/113 |
| 5,074,453 | 12/1991 | Tachihara et al. | 227/113 X |

*Primary Examiner*—Frank T. Yost
*Assistant Examiner*—Rinaldi Rada
*Attorney, Agent, or Firm*—Schwartz & Weinrieb

[57] ABSTRACT

A nail driving tool is disclosed as including a magazine (9) which, in turn, includes a guide path (7) for guiding a plurality of nails ($10_1$, $10_2$, $10_3$. . . ) which are preferably disposed in the form of a nail strip. The guide path (7) is open at an outlet opening (2) from or through which a first or leading nail ($10_1$) is conveyed into a discharge channel (3). A driving mechanism, such as, for example, a pneumatic driver (11) is disposed within the discharge channel (3) for driving or discharging the leading nail ($10_1$) from or through the discharge channel (3). A cantilevered leaf spring (8) has one end thereof fixedly mounted upon the magazine (9) while the opposite free end thereof engages the second nail ($10_2$) disposed immediately upstream of the leading nail ($10_1$) so as to retain all of the nails disposed upstream of the leading nail ($10_1$) while the leading nail ($10_1$) is disposed in its readied state for discharge from the discharge channel (3) by the driver (11). A magnet (4) is disposed within a blind bore (6) upon the opposite side of the discharge channel (3) with respect to the outlet opening (2) for retaining the leading nail ($10_1$) within the discharge channel (3) at its readied disposition for discharge by the driver (11). A bottom or end wall (5) of the blind bore (6) serves as a protection device for protecting the magnet (4) from the nails as the latter are serially conveyed into the discharge channel (3).

10 Claims, 1 Drawing Sheet

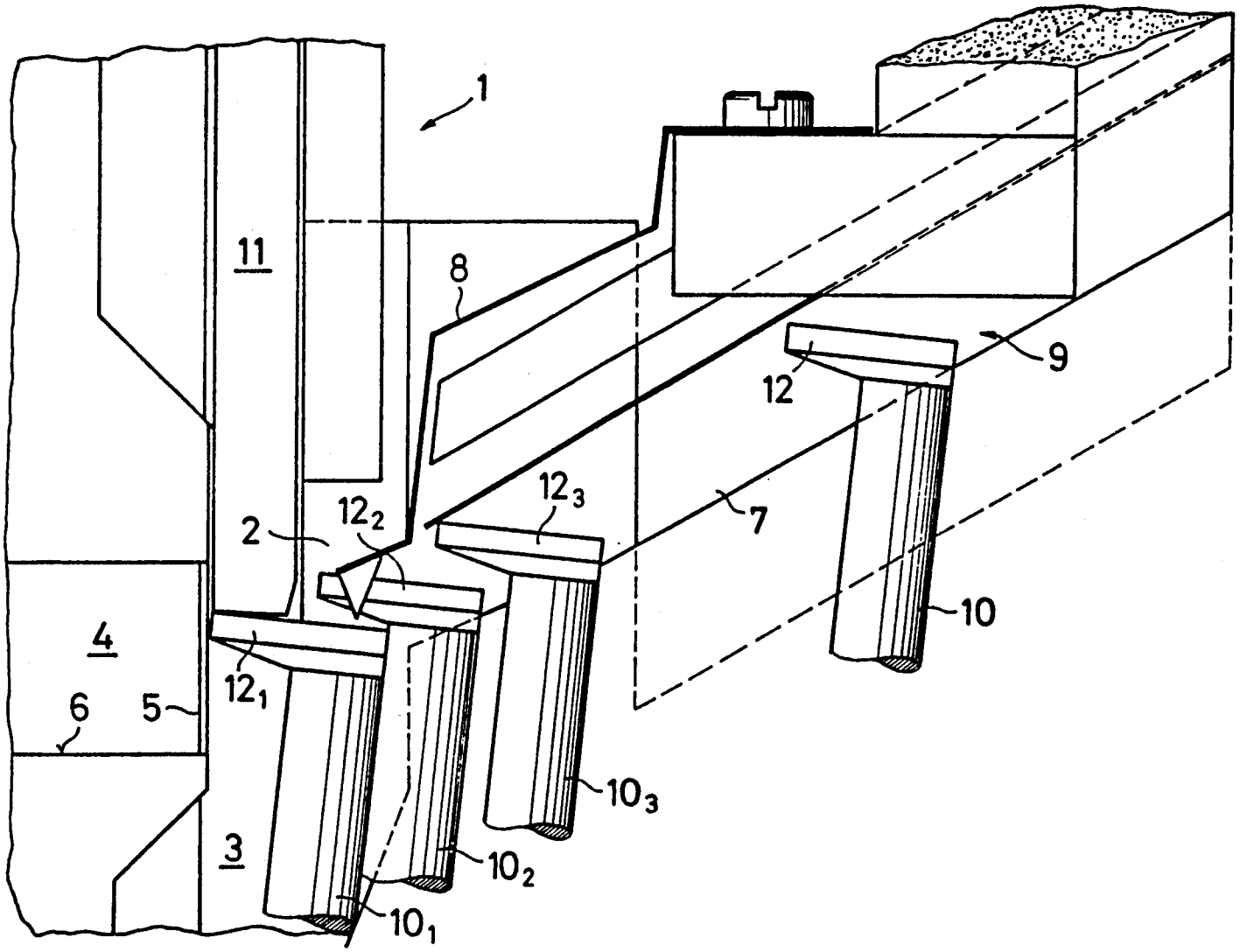
1
8
9
10
12
7
$10_3$
$12_3$
$10_2$
$10_1$
$12_2$
11
2
$12_1$
3
5
4
6

NAIL DRIVING TOOL

FIELD OF THE INVENTION

The present invention is concerned with a nail driving tool comprising a magazine for the accommodation of nails, in particular in the form of nail strips or coils, and more particularly, to a nail transporting unit associated with the nail magazine for passing the nails one by one through means of a lateral inlet opening into a discharge channel for being discharged, for example, pneumatically, a magnet being provided within the vicinity of the discharge channel for retaining at least the last and final nail of the nail strip or coil, once the same is ready for being discharged, within the discharge channel until commencement of the discharge operation.

BACKGROUND OF THE INVENTION

In the state-of-the-art nail driving tools of the aforementioned type, a magnet is disposed within a lateral orientation with respect to the vertical feed plane of the nail within the nail discharge channel. Although this may prevent the nail from an inadvertent premature discharge out of the discharge channel, the nail, with the head thereof, is not disposed at an optimum position within the discharge channel. Moreover, the interaction between the magnet and the nail head will affect such transport of the nail into the discharge channel.

OBJECT OF THE INVENTION

It is therefore the object of the present invention to provide a nail driving tool of the aforementioned type, wherein the disadvantages involved with the state of the art are avoided and wherein even the last and final nail of a nail strip or coil, once it is ready for being discharged, is transferred, without affecting the transport operation, to an optimum position within the discharge channel with no risk of inadvertently being discharged from the discharge channel.

SUMMARY OF THE INVENTION

This problem, in the practice of the present invention is substantially solved in that the magnet is located upon the side of the discharge channel opposite the inlet opening, thereby insuring an optimum nail position within the drive-out channel within which the nail, with the head thereof, is disposed in abutment with the inner face of the discharge channel. Moreover, the nail already at a distance of approximately 3 mm is attracted into the proper position within the discharge channel. The magnet does not affect the nail transport even during its final travel into the discharge channel; on the contrary, it will even enhance the same.

In order to achieve the optimum nail position within the discharge channel, the magnet, preferably, is located at the level of the nail head of the nail to be respectively discharged.

Premature wear of the magnet can be avoided in that, upon the side thereof facing the discharge channel, it is provided with a protective layer.

In accordance with a simplified embodiment of the present invention, the magnet is disposed within a depression of the tool nozzle extending in a direction substantially radial to the discharge channel.

The depression may be the blind bore type accessible from the outside, with the bottom wall thereof forming the protective layer for the magnet.

The thickness of the protective layer may, for example, be on the order of 1 mm.

Moreover, the positioning of the nail to be discharged, within the nail discharge channel, can be favorably influenced in that the magnet, upon the front side thereof facing the discharge channel, exhibits a concave form conforming to the surface of the discharge channel. Therefore, the discharge of the nail is in no way adversely affected by means of the magnet.

Within German Patent Publication DE-OS 39 01 043 there is disclosed a nail driving tool comprising a magazine for the accommodation of nails, in particular, in the form of nail strips, and further comprising a nail transport unit associated with the magazine, for passing the nails one by one through means of a lateral inlet opening into a discharge channel for discharging the nails, for example, in a pneumatic manner, with a spring being provided within the vicinity of the transport path for the nails within the region of the inlet opening so as to maintain the nail strip at a predetermined position. For such purpose, the spring is located above a guide plate which exerts pressure upon the nail heads from above and therefore acts as a pressure spring. It has been demonstrated in accordance with such a system that the last and final nail of the nail strip is thereby not retained adequately or for a sufficient length of time, for which reason, occasionally, it is inadvertently discharged from the nozzle of the nail driving tool. For, once the transport unit is retracted, the nail strip, temporarily, has no contact force impressed thereon so that the last nail of the preceding nail strip is likely to inadvertently drop into the discharge channel.

It is therefore also an object of the present invention to eliminate the disadvantages involved with nail driving tools of the aforementioned type and to provide, in particular, a nail driving tool of the aforementioned type, wherein the nail is prevented from being inadvertently discharged into the discharge channel.

This problem is substantially resolved in accordance with the practice of the present invention in that a retaining spring is provided which is of a configuration such that only the last and final nail being subjected to the pushing or biasing pressure of the transport unit is passed into the discharge channel, thereby insuring that it is only moved under the control or influence of the pushing or biasing pressure, that is, once the transport unit pushes the next nail strip forwardly, then the last nail of the preceding nail strip is reliably guided into the discharge channel.

The means comprising the magnet- or spring-type embodiment provided by means of the present invention and intended to retain at least the last nail of a nail strip or coil, once the same is ready for being discharged into or within the guide path or discharge channel, respectively, until commencement of the discharge operation may also be simultaneously provided in combination with one another so as to insure a proper function of the nail driving tool.

BRIEF DESCRIPTION OF THE DRAWINGS

Further objects, features, advantages and fields of end-use application of the present invention will become manifest from the following description of one form of embodiment with reference to the drawing, wherein all of the features described and/or graphically illustrated, by themselves or in any meaningful combination, form the subject matter of the present invention irrespective of the summarization thereof in the claims or the reference thereto, and wherein:

The SOLE FIGURE schematically shows a nail driving tool incorporating the present invention, which is provided within the transition region from the nail magazine to the nozzle thereof.

DETAILED DESCRIPTION OF THE PREFERRED EMBODIMENT

The nail driving tool 1 exhibits a magazine 9 for the accommodation of nails 10 in the form of nail strips or coils. Associated with the nail magazine is a nail transport unit (not shown) which moves the nails 10 one by one (from the right in the drawing) through a lateral inlet opening 2 into a discharge channel 3 for being driven outwardly, for example, pneumatically, by means of a driver 11. Provided within the vicinity of the discharge channel 3 is a magnet 4 for retaining at least the last nail $10_1$ of a nail strip or coil comprising nails $10_1$, $10_2$ $10_3$ . . . and disposed within the discharge channel 3, once the same is ready for being forced or driven outwardly from the discharge channel 3, until commencement of the discharge operation. Magnet 4 is located upon the side of the discharge channel 3 opposite the inlet opening 2. Magnet 4 is disposed at the level of the nail head $12_1$ of the nail $10_1$ to be respectively discharged, the subsequent nail heads $12_2$, $12_3$ . . . being respectively moved into the same position previously occupied by means of the nail head 12, when the nails are serially discharged from the tool. Upon the side facing the discharge channel 3, magnet 4 is covered by means of a protective layer 5 formed by means of the bottom wall of an aperture 6 of the tool nozzle which is in the form of a blind bore. The protective layer 5 has a thickness on the order of 1 mm.

Moreover, located at the end of the guide path 7 for the nails 10 leading from the nail magazine 9 into the opening 2, apart from a known per se clamping spring 13 disposed above and acting upon the nail strip, there is disposed, in addition to or in place of the magnet 4, a retaining spring 8 having a configuration such that only the first nail $10_1$ being subjected to the pushing or driving pressure of the transport unit will be permitted to be moved into the discharge channel 3. Hence, spring 8 can be operative both in combination with the magnet 4 or by itself.

The magnet 4 and/or the retaining spring 8 will respectively prevent the last nail $10_3$ from inadvertently being discharged into the discharge channel 3.

Obviously, many modifications and variations of the present invention are possible in light of the above teachings. It is therefore to be understood that within the scope of the appended claims, the present invention may be practiced otherwise than as specifically described herein.

What is claimed is:

1. A nail driving tool, comprising:

a magazine for housing a plurality of serially disposed nails, said magazine including a guide path along which said plurality of serially disposed nails are moved, and an outlet opening through which said plurality of serially disposed nails are serially conveyed from said guide path;

a discharge channel, disposed adjacent to said outlet opening of said guide path, through which a leading one of said plurality of serially disposed nails, conveyed through said outlet opening of said guide path, is discharged;

means for engaging said leading one of said plurality of serially disposed nails which is disposed within said discharge channel for discharging said leading one of said plurality of serially disposed nails through said discharge channel; and a cantilevered leaf spring having a first proximal end thereof fixedly mounted upon said magazine and an opposite, distal free end thereof engaged with a nail, of said plurality of serially disposed nails, which is disposed immediately upstream of said leading one of said serially disposed nails disposed within said discharge channel, for retaining all of said plurality of serially disposed nails disposed within said guide path and upstream of said leading one of said serially disposed nails disposed within said discharge channel.

2. A tool as set forth in claim 1, wherein:

said plurality of serially disposed nails comprises a nail strip.

3. A tool as set forth in claim 1, wherein:

said means for engaging said leading one of said plurality of serially disposed nails comprises a pneumatic driver.

4. A nail driving tool, comprising:

a magazine for housing a plurality of serially disposed nails, said magazine including a guide path along which said plurality of serially disposed nails are moved, and an outlet opening through which said plurality of serially disposed nails are serially conveyed from said guide path;

a discharge channel, disposed adjacent to said outlet opening of said guide path, through which a leading one of said plurality of serially disposed nails, conveyed through said outlet opening of said guide path, is discharged;

means for engaging said leading one of said plurality of serially disposed nails which is disposed within said discharge channel for discharging said leading one of said plurality of serially disposed nails through said discharge channel;

a cantilevered leaf spring having a first proximal end thereof fixedly mounted upon said magazine and an opposite, distal end thereof engaged with a nail, of said plurality of serially disposed nails, which is disposed immediately upstream of said leading one of said plurality of serially disposed nails disposed within said discharge channel, for retaining all of said plurality of serially disposed nails disposed within said guide path and upstream of said leading one of said plurality of serially disposed nails disposed within said discharge channel; and magnet means disposed upon a side of said discharge channel which is opposite the side upon which said outlet opening of said guide path is disposed and within the vicinity of said leading one of said plurality of serially disposed nails for retaining said leading one of said plurality of serially disposed nails within said discharge channel in preparation of said discharge of said leading one of said plurality of serially disposed nails from said discharge channel by said means for engaging said leading one of said plurality of serially disposed nails.

5. A tool as set forth in claim 4, wherein:

said magnet means is disposed at an elevational level which corresponds to a head portion of said leading one of said plurality of serially disposed nails.

6. A tool as set forth in claim 4, further comprising:

a blind bore defined within said tool for housing said magnet means.

7. A tool as set forth in claim 6, wherein:

said blind bore defined within said tool includes an end wall which is interposed between said magnet means and said leading one of said plurality of serially disposed nails for protecting said magnet means from being directly engaged by said leading one of said plurality of serially disposed nails.

8. A tool as set forth in claim 7, wherein:

said end wall has a thickness of approximately 1 mm.

9. A tool as set forth in claim 4, wherein:

said plurality of serially disposed nails comprises a nail strip.

10. A tool as set forth in claim 4, wherein:

said means for engaging said leading one of said plurality of serially disposed nails comprises a pneumatic driver.

* * * * *